US005087180A

United States Patent [19]

Clapp

[11] Patent Number: 5,087,180

[45] Date of Patent: Feb. 11, 1992

[54] FLUID MOTOR HAVING REDUCED LUBRICATION REQUIREMENT

[75] Inventor: John M. Clapp, Sayre, Pa.

[73] Assignee: Ingersoll-Rand Company, Woodcliff Lake, N.J.

[21] Appl. No.: 733,054

[22] Filed: Jul. 15, 1991

Related U.S. Application Data

[63] Continuation of Ser. No. 511,111, Apr. 19, 1990, abandoned.

[51] Int. Cl.[5] ..... F04C 2/344

[52] U.S. Cl. ..... 418/152; 418/178; 418/179; 418/133

[58] Field of Search ..... 418/133, 152, 178, 179

[56] References Cited

U.S. PATENT DOCUMENTS

| | | | |
|---|---|---|---|
| 763,525 | 6/1904 | Van Beresteyn | 418/178 |
| 2,492,935 | 12/1949 | McCulloch et al. | 418/178 |
| 3,190,183 | 6/1965 | Walker et al. | 418/178 |
| 3,439,422 | 4/1969 | Doeden et al. | 418/152 |
| 3,920,360 | 11/1975 | Bierlein | 418/178 |
| 4,072,451 | 2/1978 | Niemiec | 418/178 |
| 4,198,195 | 4/1980 | Sakamaki et al. | 418/133 |
| 4,276,007 | 6/1981 | Sakamaki et al. | 418/178 |
| 4,509,906 | 4/1985 | Hattori et al. | 418/152 |
| 4,711,620 | 12/1987 | Takahashi et al. | 418/179 |
| 4,804,317 | 2/1989 | Smart et al. | 418/152 |
| 4,820,140 | 4/1989 | Bishop | 418/152 |
| 4,846,122 | 7/1989 | Kristof et al. | 418/178 |

FOREIGN PATENT DOCUMENTS

| | | | |
|---|---|---|---|
| 578845 | 4/1986 | Australia . | |
| 2752233 | 6/1979 | Fed. Rep. of Germany | 418/152 |

OTHER PUBLICATIONS

*Encyclopedia of Engineering Materials & Processes,* Clauser, Ed. (Reinhold Publishing Co., London) S.V. Carbon & Graphite.

Miner, Ed., *Handbook of Engineering Materials, First Ed.* (Wiley and Sons Inc. New York, pp. 3-330 to 3-345.

*Materials Engineering,* "Materials Selector 1991" (A Penton Publication) Dec. 1990, pp. 144, 188-189.

Modern Plastics Mid October Encyclopedia Issue, "Composite Raw Materials," pp. 225-252.

*Primary Examiner*—Richard A. Bertsch
*Assistant Examiner*—David L. Cavanaugh
*Attorney, Agent, or Firm*—Robert F. Palermo

[57] ABSTRACT

A fluid powered vane motor for operation with a minimum of externally supplied lubrication has a motor chamber made up of a cylinder with an eccentric cylindrical bore and end plates abutting the ends of the cylinder. A rotor with a plurality of axially oriented radial slots on its circumferential surface is supported on bearing means within the chamber. Radially slidable vanes are disposed in the radial slots of the rotor so that they form a moving seal between the rotor surface and the cylinder wall. Pressurized fluid introduced to the motor chamber acts upon the vanes of the rotor and imparts rotary motion thereto. Operation with a limited amount of externally supplied lubrication is accomplished by making end plates of inherently lubricious material such as fiber-reinforced polymeric material, and by coating the innner bore of the cylinder with a soft coating having lubricious properties in contact with the selected vane material.

11 Claims, 2 Drawing Sheets

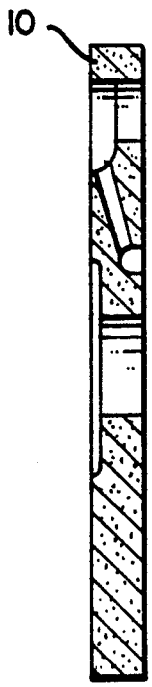
FIG. 4
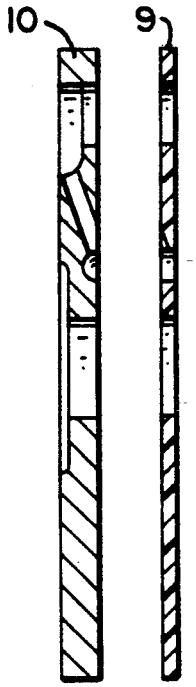
FIG. 2
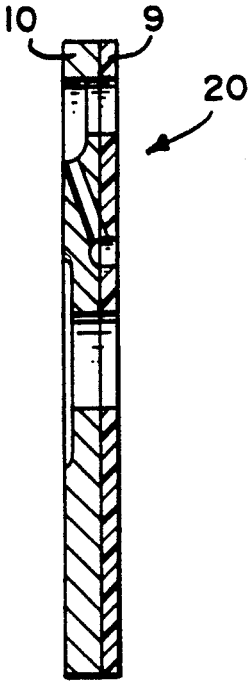
FIG. 3
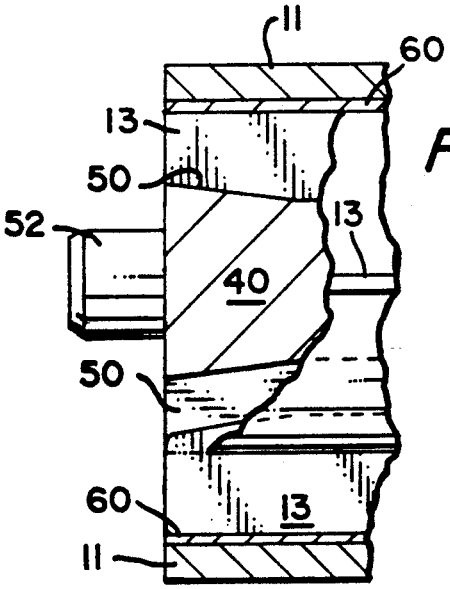
FIG. 5
FIG. 6
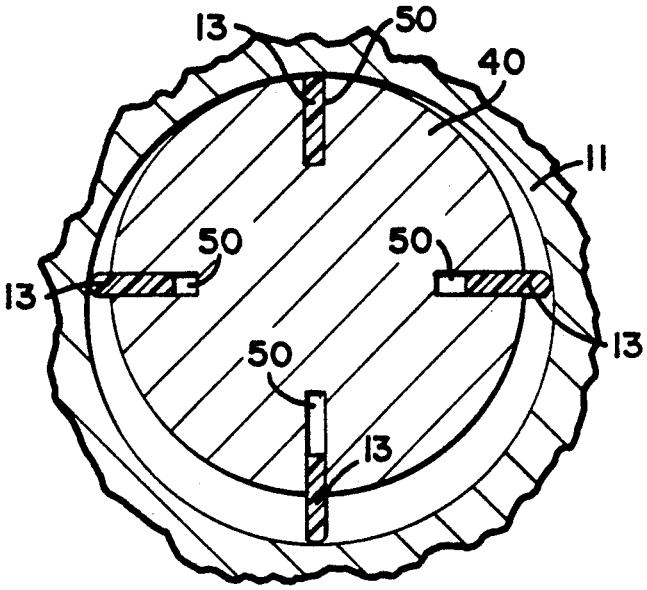

FLUID MOTOR HAVING REDUCED LUBRICATION REQUIREMENT

This application is a continuation of application Ser. No. 07/511,111, filed Apr. 19, 1990, now abandoned.

BACKGROUND OF THE INVENTION

This invention relates generally to fluid powered vane type motors and more particularly to air powered engine starter motors.

Air or gas powered vane type motors are typically capable of very high rotational speeds. Because of these high speeds, and because of the moisture and other contaminants which are often found in compressed air systems, air motors typically require a supply of oil to provide lubrication and corrosion protection. Lack of an adequate oil supply typically results in rapid wear of the rotor, end plates, vanes, cylinder bore, and rotor shaft.

In air powered engine starter motors, this requirement for lubrication and corrosion protection is typically satisfied by a connection which bleeds diesel fuel into the air motor, or by an in-line lubricator. Either of these mechanisms provides a lubricant which, entrained in the compressed air, creates an oil mist which lubricates the moving parts of the air motor. Much of this lubricant is exhausted from the motor with the exhaust air.

Environmental protection requirements have become increasingly stringent over the past several years. This has generated a significant interest in achieving operation of air starter motors using a minimum of externally supplied lubrication.

Efforts to eliminate or reduce the need for lubrication have typically included hard facing of wear surfaces often coupled with superfinish surfaces to minimize friction. Another contribution to reduction of friction was achieved many years ago incidental to the replacement of metal vanes with fiber-reinforced polymeric vanes. This replacement was, at the time, motivated primarily by reductions of weight and cost of manufacturing.

Application of hard facing and polishing to achieve the previously mentioned superfinish significantly increases the manufacturing costs and the number of manufacturing operations required. Moreover, merely hardening and smoothing the wear surfaces of the unit will not eliminate wear. The friction experienced in high speed unlubricated operation can generate temperatures sufficient to soften, or even melt, the most refractory metals. Hence, it is not enough to merely harden and smooth the surfaces—a degree of lubricity must be introduced to the interface without adding an excess of external lubricant.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the invention, this is accomplished by providing a fluid powered vane motor for operation with a reduced amount of externally supplied lubricant comprising a rotor having a plurality of axially oriented radial slots in its circumferential surface, rotatably supported within a cylinder on bearings in an eccentric longitudinal bore which is covered with a soft metal coating. A plurality of radially slidable vanes are situated in the radial slots of the rotor. End plates having inherent lubricity are abutted to the ends of the cylinder, the rotor, and the vanes to form an enclosed rotor chamber. Supply and exhaust of motive fluid is channeled through appropriate piping.

The foregoing and other aspects will become apparent from the following detailed description of the invention when considered in conjunction with the accompanying drawing figures.

BRIEF DESCRIPTION OF THE DRAWING FIGURES

FIG. 2 is a lateral cross sectional view of one embodiment of the end plate of this invention;

FIG. 3 is a lateral cross sectional elevation view of another embodiment of the end plate of the present invention;

FIG. 4 is a lateral cross sectional elevation view of yet another embodiment of the present invention;

FIG. 5 is a longitudinal cross section of the motor cylinder; and

FIG. 6 is a transverse cross section of the rotor body.

DETAILED DESCRIPTION

Figure 1:
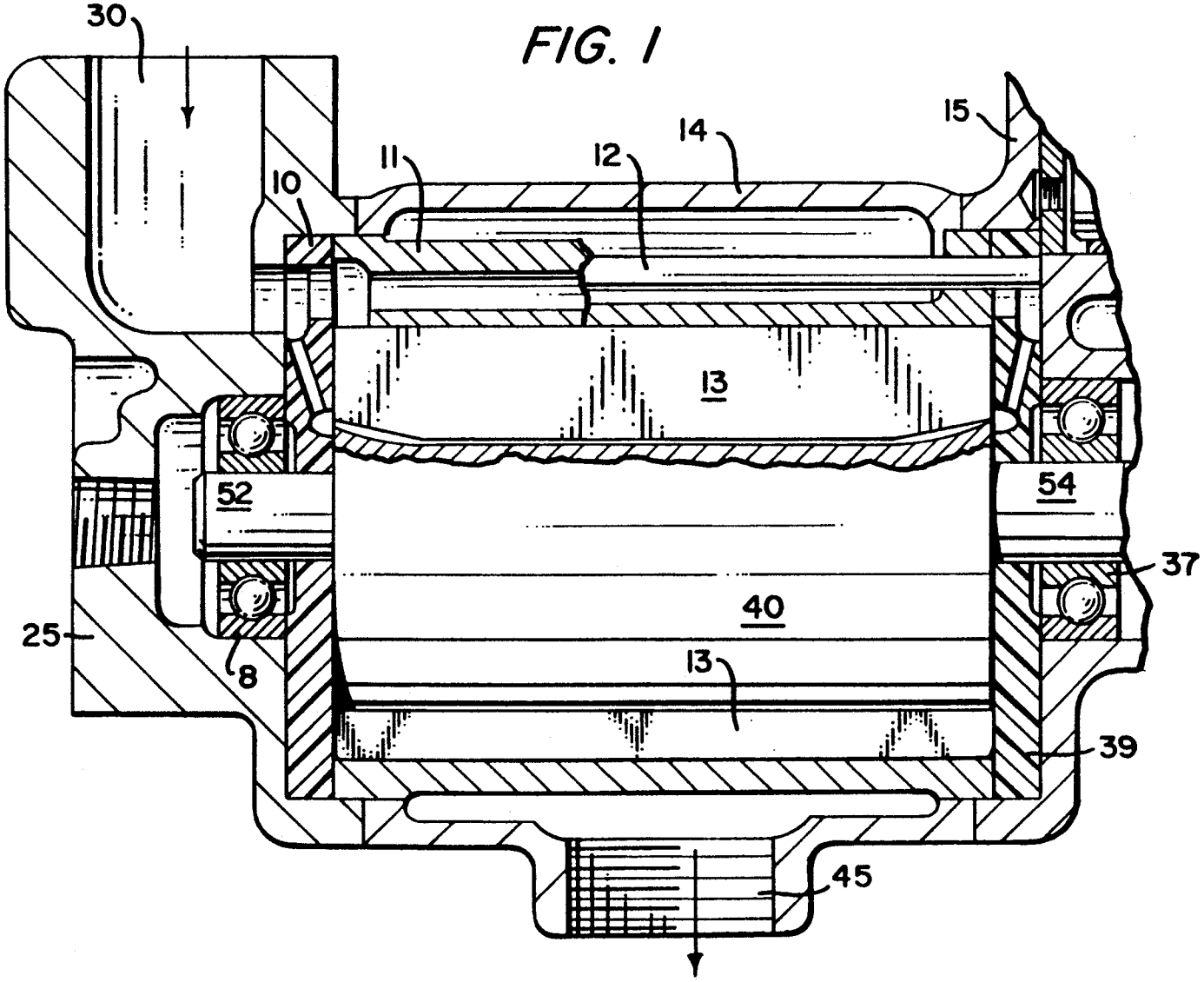
FIG. 1 is a fragmentary partial sectional view of the fluid powered vane motor portion of an engine starting motor.

Referring now to the drawings, FIG. 1 illustrates a starter motor showing details of the rotor and rotor chamber. The gear case 15 contains the planetary gear output, the starter engagement system, and the flywheel ring gear drive pinion. Motor housing cover assembly 25 contains air inlet port 30 and rear rotor bearing 8. The motor housing cover assembly 25 together with the motor housing 14 and the gear case assembly 15 forms the housing of the starting motor. Motor housing 14 contains exhaust port 45 through which air is exhausted after it has passed through the rotor chamber.

The rotor chamber is formed by the cylinder 11 which has an eccentrically placed cylindrical bore in which is situated the rotor 40. The rotor 40 is equipped with vanes 13 which are slidably engaged in slots 50 (shown in FIG. 6) and with rear shaft 52 and front shaft 54 which are rotatably supported in rear rotor bearing 8 and front rotor bearing 37, respectively. Rear end plate 10 and front end plate 39 are axially abutted to cylinder 11. Proper radial alignment between rear end plate 10, cylinder 11, and front end plate 38 is provided by cylinder dowel 12.

In FIG. 1, rear end plate 10 and front end plate 39 are shown as being made of fiber-reinforced polymeric material. FIGS. 2, 3, and 4 present lateral cross sectional elevation views of other end plate construction options. Only one end plate is shown in each figure since the construction is the same whether applied to a front or rear end plate. For purposes of discussion of these three figures, the numbering of the rear end plate will be used, however, note that the same construction also applies to front end plates.

FIG. 2 shows rear end plate 10 which is, in this case, made of metal. Also shown is rear end plate buffer 9 which is formed from fiber-reinforced polymeric material and is interposed between end plate 10 and rotor 40. This provides the inherent lubricity required for operation with a reduced level of externally supplied lubrication.

FIG. 3 shows the same rear end plate 10, made of metal, and rear end plate buffer 9, made of fiber-reinforced polymeric material, bonded together to form end plate unit 20. This unitary end plate construction simplifies assembly of the motor and provides slightly greater rigidity to the end plates.

FIG. 4 shows another rear end plate 10. This time it is constructed of porous sintered metal and impregnated with a lubricant. This also provides the lubricity required at the interface between end plate 10 and rotor 40 in order to prevent wear and galling.

I have described four options for construction of the end plates for this invention. The option chosen is determined by several factors including ease of manufacture, cost, and performance data. The preferred embodiment for most cases is that shown in FIG. 3 where an end plate unit 20 is formed by bonding metal end plate 10, 39, and fiber-reinforced polymeric end plate buffer 9, 38.

FIG. 5 shows a fragmentary longitudinal cross section of cylinder 11 on which a soft metal coating 60 is deposited to form a low friction surface in contact with the fiber-reinforced polymeric vanes 13. In some applications, it may be desirable to substitute lubricant impregnated vanes 13 for the soft cylinder coating 60 or to use the soft coating 60 in combination with the impregnated vanes 13. In other cases, if metallic vanes 13 are used, the soft coating 60 may be a lubricant impregnated polymeric or metallic layer. The vanes 13 are carried in slots 50 on rotor 40 eccentrically placed in the cylindrical bore of cylinder 11. When rotor 40 turns, vanes 13 follow the bore surface due to hydrodynamic and centrifugal forces.

FIG. 6 is a fragmentary end view of rotor 40 showing slots 50 and vanes 13 engaged therein. Cylinder 11 is also outlined to show the eccentric placement of rotor 40 within cylinder 11.

This figure also shows how the eccentric placement of the rotor 40 within cylinder 11 causes vanes 13 to follow a radially reciprocating path within vane slots 50. Pressurized fluid is introduced between rotor 40 and cylinder 11 at a location where rotor 40 and cylinder 11 are in very close proximity. This fluid acts upon vanes 13, Which seal the gap between rotor 40 and cylinder 11, to impart driving force to rotor 40.

In operation, this is mechanically the same as most van type air starting motors. The difference lies in the provision of inherent lubricity at critical locations in the motor. Thus, provision of the lubricious end plates, lubricious vanes, and/or the soft cylinder coating has made it possible to reduce the amount of lubricating oil in the air stream, thereby simplifying installation, reducing oil consumption, and reducing or eliminating air pollution.

While this invention has been illustrated and described in accordance with the preferred embodiment, it is recognized that variations and changes may be made therein without departing from the invention as set forth in the claims.

What is claimed is:

1. A fluid powered vane motor, for operation with a reduced amount of externally supplied lubrication, comprising:

a cylinder having longitudinal cylindrical bore;

a soft metal coating applied to the surface of said longitudinal bore;

a rotor rotatably eccentrically supported within said cylinder on bearing means and having a plurality of axially oriented radial slots;

a plurality of fiber reinforced polymeric vanes slidably disposed in said radial slots;

stationary porous metal end plates impregnated with a lubricant and abutting both ends of said cylinder bore, said rotor, and said vanes; and means for supplying and exhausting motive fluid.

2. In a fluid powered vane motor of the type having a cylinder with a longitudinal cylindrical bore, a rotor within said bore eccentrically supported by bearings and having axially oriented radial slots, radially slidable vanes in said slots, stationary end plates abutting the ends of the cylinder, the vanes, and the rotor, and inlet and exhaust openings in the cylinder and end plates for motive fluid, the improvement comprising:

a soft metal coating applied to the inner surface of the longitudinal cylindrical bore; and fiber reinforced polymeric end plate buffers buttressed by metal backup plates to serve as the stationary end plates.

3. The fluid powered vane motor of claim 1, wherein the fiber reinforced polymeric vanes are formed with porosity and are impregnated with lubricant.

4. An air powered engine starter, for operation with a reduced amount of externally supplied lubrication, comprising:

a cylinder having a longitudinal cylindrical bore, said bore being coated with a soft metal layer;

a rotor having a plurality of axially oriented radial slots on its circumferential surface and being rotatably eccentrically supported within said cylinder on bearing means;

a plurality of radially slidable fiber rreinforced polymeric vanes disposed in said radial slots;

stationary fiber reinforced polymeric buffer plates, which are buttressed by metal backup plates and which form an enclosed rotor chamber when abutted to the ends of said rotor and the ends of said cylinder, said buffer plates providing low-friction contact with the rotor and the vanes;

means for transmitting starting power to said engine; and means for supplying and exhausting air.

5. The air powered engine starter of claim 4 wherein said fiber reinforced polymeric buffer plates and said metal backup plates are bonded together to form two metal/polymer end plate units.

6. The air powered engine starter of claim 4 wherein said fiber-reinforced polymeric buffer plates are impregnated with a lubricant.

7. The air powered engine starter of claim 5 wherein said fiber reinforced polymeric buffer plates are impregnated with a lubricant.

8. A fluid powered vane motor, for operation with a reduced amount of externally supplied lubrication, comprising:

a cylinder having a longitudinal cylindrical bore;

a soft metal coating applied to the surface of said longitudinal bore;

a rotor having a plurality of axially oriented radial slots on its circumferential surface and being rotatably supported eccentrically within said cylinder on bearing means;

a plurality of radially slidable fiber reinforced polymeric vanes disposed in said radial slots;

stationary fiber reinforced polymeric buffer plates, which are buttressed by metal backup plates, and which form an enclosed rotor chamber when abutted to the ends of said rotor and the ends of said cylinder, said buffer plates providing low-friction contact with the rotor and the vanes; and means for supplying and exhausting motive fluid.

9. The fluid powered vane motor of claim 1 wherein said fiber reinforced polymeric buffer plates and said metal backup plates are bonded together to form two metal/polymer end plate units.

10. The fluid powered vane motor of claim 1 wherein said fiber reinforced polymeric end plates are impregnated with a lubricant.

11. The fluid powered vane motor of claim 9 wherein said polymeric buffer plates are impregnated with a lubricant.

* * * * *